US010646902B2

(12) United States Patent
Lutz et al.

(10) Patent No.: US 10,646,902 B2
(45) Date of Patent: May 12, 2020

(54) HALF ROUND CYLINDRICAL CONFIGURATION FOR DEDUSTING APPARATUS

(71) Applicant: Pelletron Corporation, Lancaster, PA (US)

(72) Inventors: Joseph T. Lutz, Lancaster, PA (US); Heinz Schneider, Lancaster, PA (US); Amit K. Gautam, Lancaster, PA (US)

(73) Assignee: Pelletron Coeporation, Lancaster, PA (US)

( * ) Notice: Subject to any disclaimer, the term of this patent is extended or adjusted under 35 U.S.C. 154(b) by 0 days.

(21) Appl. No.: 15/975,002

(22) Filed: May 9, 2018

(65) Prior Publication Data

US 2018/0339315 A1 Nov. 29, 2018

Related U.S. Application Data

(60) Provisional application No. 62/509,844, filed on May 23, 2017.

(51) Int. Cl.

| | |
|---|---|
| ***B08B 5/00*** | (2006.01) |
| ***B07B 11/04*** | (2006.01) |
| ***B07B 11/06*** | (2006.01) |
| ***B07B 4/08*** | (2006.01) |
| ***B07B 4/02*** | (2006.01) |
| ***B07B 11/02*** | (2006.01) |
| *B07B 7/02* | (2006.01) |

(52) U.S. Cl.

CPC ..... *B08B 5/00* (2013.01); *B07B 4/02* (2013.01); *B07B 4/08* (2013.01); *B07B 11/02* (2013.01); *B07B 11/04* (2013.01); *B07B 11/06* (2013.01); *B07B 7/02* (2013.01); *B07B 2201/04* (2013.01)

(58) Field of Classification Search

CPC .... B07B 4/02; B07B 4/08; B07B 7/02; B07B 11/02; B07B 11/04; B07B 11/06; B07B 2201/04; B08B 5/00

See application file for complete search history.

(56) References Cited

U.S. PATENT DOCUMENTS

| | | | |
|---|---|---|---|
| 5,035,331 | A | 7/1991 | Paulson |
| 7,380,670 | B2 | 6/2008 | Paulson et al. |
| 8,312,994 | B2 | 11/2012 | Schneider et al. |

(Continued)

*Primary Examiner* — Terrell H Matthews
*Assistant Examiner* — Kalyanavenkateshware Kumar
(74) *Attorney, Agent, or Firm* — Miller Law Group, PLLC

(57) ABSTRACT

A half round dedusting apparatus for removes dust and debris from particulate material passing through the dedusting apparatus. The configuration of the dedusting apparatus includes a half round cylindrical housing in which is mounted a partial cone wash deck having a reverse partial cone deflector that is vertically moveable to vary the flow rate of particulate material passing over the wash deck. The product inlet port is preferably circular and directs contaminant-laden particulate material inside the deflector to pass over the surface of the wash deck. The housing has a greater diameter than the maximum diameter of the wash deck to establish a Venturi zone around the circumference of the wash deck. The wash deck and deflector are detachably mounted within the housing to allow removal thereof for ease of cleaning the wash deck and also the interior of the housing.

19 Claims, 18 Drawing Sheets

(56) References Cited

U.S. PATENT DOCUMENTS

| | | | | |
|---|---|---|---|---|
| 8,857,622 | B2 * | 10/2014 | Schneider | B07B 4/02<br>209/138 |
| 2010/0236583 | A1 * | 9/2010 | Schneider | B07B 4/02<br>134/34 |

* cited by examiner

Fig. 18
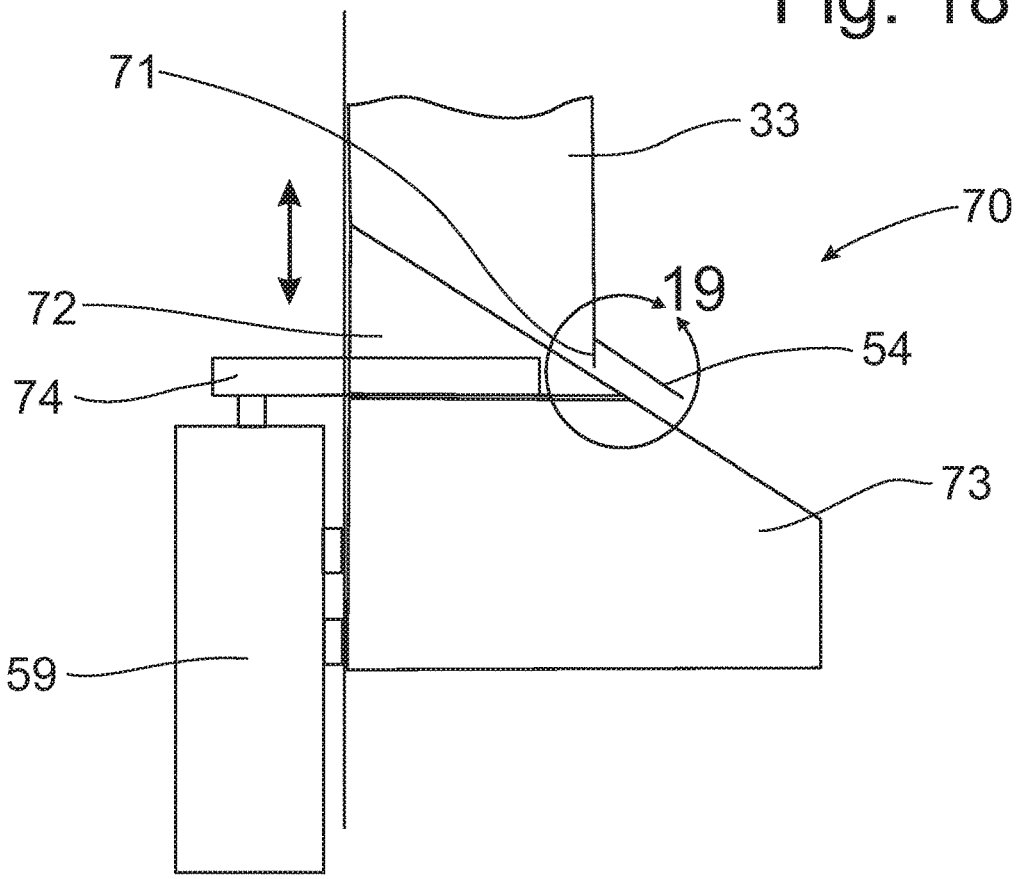
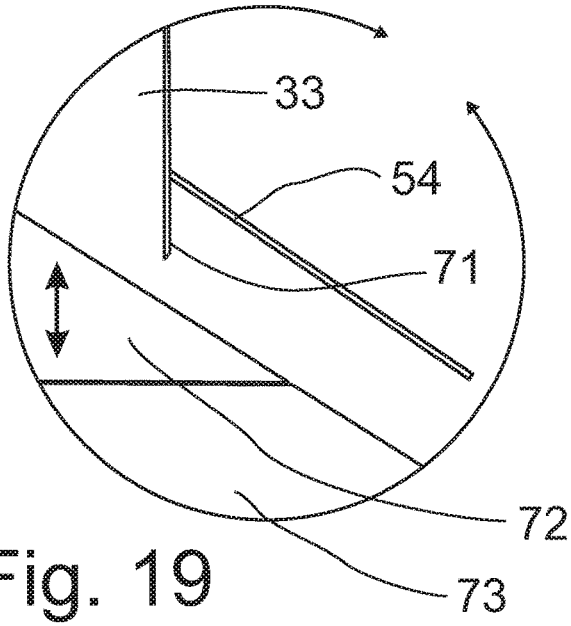
Fig. 19
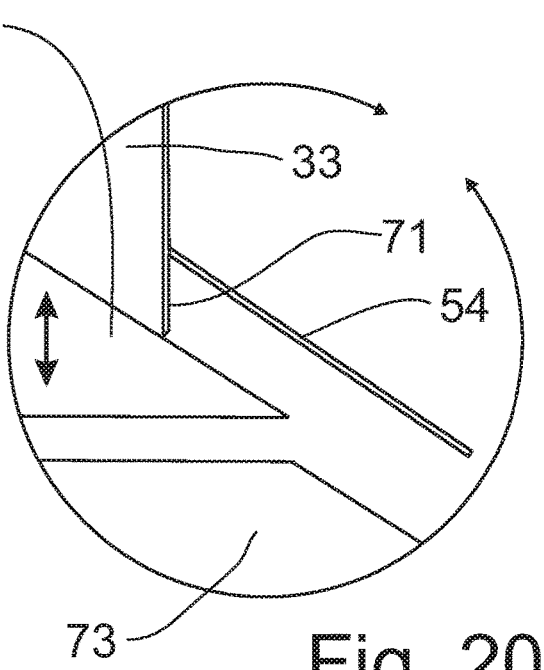
Fig. 20

HALF ROUND CYLINDRICAL CONFIGURATION FOR DEDUSTING APPARATUS

CROSS-REFERENCE TO RELATED APPLICATIONS

This application claims domestic priority on U.S. Provisional Patent Application Ser. No. 62/509,844, filed on May 23, 2017, the content of which are incorporated herein by reference.

FIELD OF THE INVENTION

The invention disclosed in this application is directed generally to the cleaning and handling of particulate materials, such as plastic pellets, regrind, tablets, grains, minerals, and the like, and particularly to a dedusting apparatus that is configured in a half round cylindrical configuration to provide an effective operative capacity.

BACKGROUND OF THE INVENTION

It is well known, particularly in the field of transporting and using particulate materials, commonly coarse powders, granules, pellets, and the like that it is important to keep product particles as free as possible of contaminants. Particulates are usually transported within a facility where they are to be mixed, packaged or used in a pressurized tubular system that in reality produces a stream of material that behaves somewhat like a fluid. As these materials move through the pipes, considerable friction is generated not only among the particles themselves, but also between the tube walls and the particles in the stream. In turn, this friction results in the development of particle dust, broken particles, fluff, and streamers (ribbon-like elements that can "grow" into quite long and tangled wads that will impede the flow of materials or even totally block the flow). The characteristics of such a transport system are quite well known, as is the importance and value of keeping product particles as free as possible of contaminants.

The term "contaminant" as used herein includes a broad range of foreign material, as well as the broken particles, dust, fluff and streamers mentioned in the preceding paragraph. In any case, contaminants are detrimental to the production of a high quality product, and in some situations a health risk to employees of the producer and possibly even a source of danger in that some contaminants can produce a dust cloud which, if exposed to an ignition source, may explode.

Considering product quality, and focusing on moldable plastics as a primary example, foreign material different in composition from the primary material, such as dust, non-uniform material of the primary product, fluff, and streamers, does not necessarily have the same melting temperatures as the primary product and causes flaws when the material is melted and molded. These flaws result in finished products that are not uniform in color, may contain bubbles, and often appear to be blemished or stained, and, therefore, cannot be sold. Heat in the injection molding machine can vaporize dust that leads to tiny gas bubbles in the finished product. Heat also burns dust and causes "black spots", actually carbonized dust. Sometimes dust pockets in the machine don't melt and cause "soft spots" or "white spots" as these defects are commonly called. It is important to note that, since these same non-uniform materials often do not melt at the same temperature as the primary product, the un-melted contaminants cause friction and premature wear to the molding machines, resulting in downtime, lost production, reduced productivity, increased maintenance and, thus, increased overall production costs.

Conventional particulate material dedusting devices, such as is disclosed in U.S. Pat. No. 5,035,331, granted to Jerome I. Paulson on Jul. 30, 1991, utilize first and second wash decks, formed as sloped planar surfaces within the apparatus and having openings therein for the passage of pressurized air therethrough to pass through particulate material flowing along the wash decks. Between the two wash decks, the particulate material passes through a Venturi zone, which combined with the passage of air through the particulate material on the wash decks, discharges dust and other contaminants upwardly with the air flow to be discharged from the apparatus.

In U.S. Pat. No. 7,380,670, granted on Jun. 3, 2008, to Jerome I. Paulson, Heinz Schneider and Paul Wagner, a compact dedusting apparatus having back-to-back wash deck assemblies, provides increased capacity by doubling the wash decks and the Venturi zones, which requires the inflow of particulate material to be equally divided between the two wash deck assemblies. In both U.S. Pat. No. 5,035,331 and U.S. Pat. No. 7,380,670, a magnetic flux field is applied to the infeed of particulate material to neutralize the static charges attracting the contaminants to the particulate pellets to enhance the operation of the wash decks in separating contaminants from the particulate material.

U.S. Pat. No. 8,312,994, granted on Nov. 20, 2012, to Heinz Schneider and Paul Wagner, the dedusting apparatus is cylindrical in general shape and configuration with the inflow of particulate material being passed over an inverted conical wash deck to provide a flow of cleansing air through a flow path extending 360 degrees around the circumference of the conical wash deck. Due to construction tolerances, the flow of particulate material does not always extend uniformly around the entire circumference of the conical wash deck, which results in a decrease in operational efficiency, even though the operational efficiency is still deemed to be greater than many prior art dedusting devices.

Accordingly, it would be desirable to provide a half cylindrical dedusting apparatus that would be operable to focus the flow of particulate material and the cleansing air flow over a semi-conical wash deck to separate contaminants from greater quantities of particulate material without increasing the overall size of the dedusting apparatus. It would still be desirable to provide wash deck and Venturi zone operations similar to that of conventional conical wash deck used in a cylindrical dedusting apparatus to provide proper cleaning operations.

SUMMARY OF THE INVENTION

It is an object of this invention to provide a particulate material dedusting apparatus that provides enhanced removal of dust and debris from particulate materials passing through the apparatus.

It is another object of this invention to provide a simply operable particulate material dedusting apparatus that does not sacrifice output production or quality.

It is a feature of this invention that the wash deck is formed as a semi-conical, or partial cone, configuration.

It is an advantage of this invention that the housing surrounding the wash deck is formed as a half-round cylinder.

It is another advantage of this invention that the manufacturing costs of the dedusting apparatus are reduced in comparison with a fully cylindrical configuration.

It is another feature of this invention that the material inlet opening can be formed as a semi-circular cylinder to conform to the shape of the partial conical wash deck, or preferably as a full circular inlet opening even though the wash deck is formed as a partial cone.

It is still another feature of this invention that the cleaned product outlet port can also be formed as a semi-circular opening to conform to the shape of partial conical wash deck, but is preferably formed as a full circular outlet opening to correspond to the full circular product inlet opening.

It is yet another feature of this invention that the wash deck and deflector are removable from the housing structure.

It is still another advantage of this invention that the wash deck and deflector can be removed from the housing by passing through the front door of the housing structure.

It is yet another advantage of this invention that with the wash deck and deflector removed, the interior of the housing can be cleaned easily.

It is still another feature of this invention that the contaminant laden air passing through the wash deck and the Venturi zone continues to the top of the housing due to the pressure differential between the air inlet port and the air discharge port.

It is another feature of this invention that the deflector is vertically movable relative to the wash deck to control the rate of flow of particulate material over the surface of the wash deck.

It is still another feature of this invention that the deflector structure is formed with a vertical knife member that is operably connected to an actuator to affect movement thereof.

It is still another advantage of this invention that the flow control of particulate material through the dedusting apparatus can be controlled remotely.

It is a further feature of this invention that the contaminant-laden air is discharged through openings in the rear plate of the housing on opposing sides of the electromagnetic coil surrounding the product inlet port.

It is yet another object of this invention to provide a dedusting apparatus for cleaning particulate material by separating contaminants therefrom and having a housing that includes a semi-cylindrical front housing and a planar back wall; a product inlet port having a product inlet tube through which particulate material is introduced into said housing and a product discharge port through which particulate material is discharged from the housing; and a partial-conical wash deck terminating in a tip located at a center of curvature of the product inlet tube against the back wall to direct the flow of said contaminant-laden particulate material uniformly over the partial-conical wash deck.

It is a further object of this invention to provide a compact dedusting apparatus that has a compact configuration for the collected dust and debris, which is durable in construction, inexpensive of manufacture, carefree of maintenance, easy to assemble, and simple and effective in use.

These and other objects, features and advantages are accomplished according to the instant invention by providing a half round dedusting apparatus for removing dust and debris from particulate material passing through the dedusting apparatus. The configuration of the dedusting apparatus includes a half round cylindrical housing in which is mounted a partial cone wash deck having a reverse partial cone deflector that is vertically moveable to vary the flow rate of particulate material passing over the wash deck. The product inlet port is preferably circular and directs contaminant-laden particulate material inside the deflector to pass over the surface of the wash deck. The housing has a greater diameter than the maximum diameter of the wash deck to establish a Venturi zone around the circumference of the wash deck. The wash deck and deflector are detachably mounted within the housing to allow removal thereof for ease of cleaning the wash deck and also the interior of the housing.

BRIEF DESCRIPTION OF THE DRAWINGS

The advantages of this invention will become apparent upon consideration of the following detailed disclosure of the invention, especially when taken in conjunction with the accompanying drawings wherein:

FIG. 18 is a partial cross-sectional detail view of an alternative product flow control apparatus;

FIG. 19 is an enlarged partial cross-sectional view of the alternative product flow control apparatus corresponding to circle 19 in FIG. 18, the components being positioned to allow particulate material to flow from the product inlet port over the partial cone wash deck; and FIG. 20 is an enlarged partial cross-sectional view of the alternative product flow control apparatus corresponding to circle 19 in FIG. 18, the components being positioned to stop the flow of particulate material from the product inlet port over the partial cone wash deck.

DETAILED DESCRIPTION OF THE PREFERRED EMBODIMENT

Figure 1:
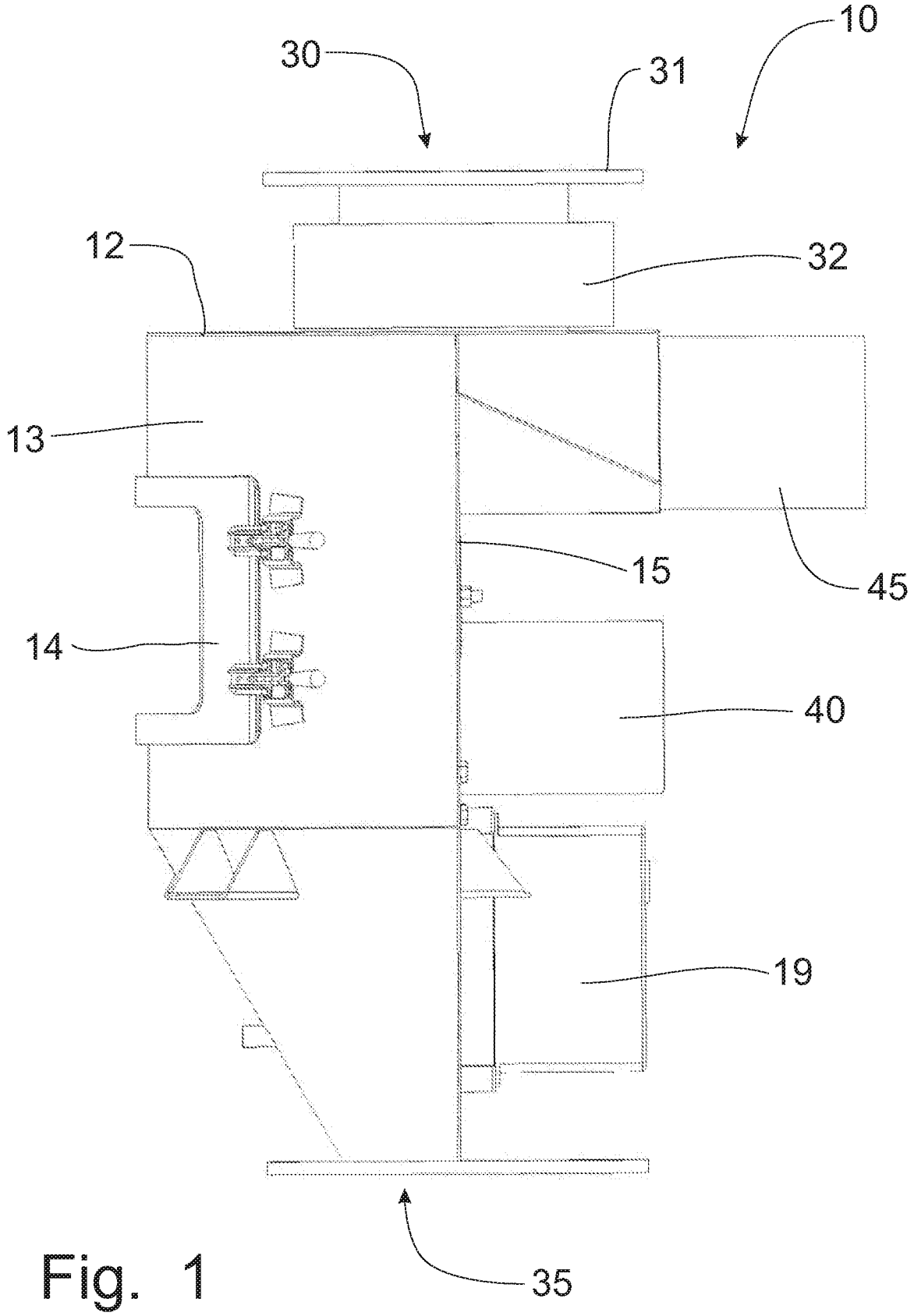
FIG. 1 is a left side elevational view of a half round cylindrical dedusting apparatus incorporating the principles of the instant invention.
Figure 2:
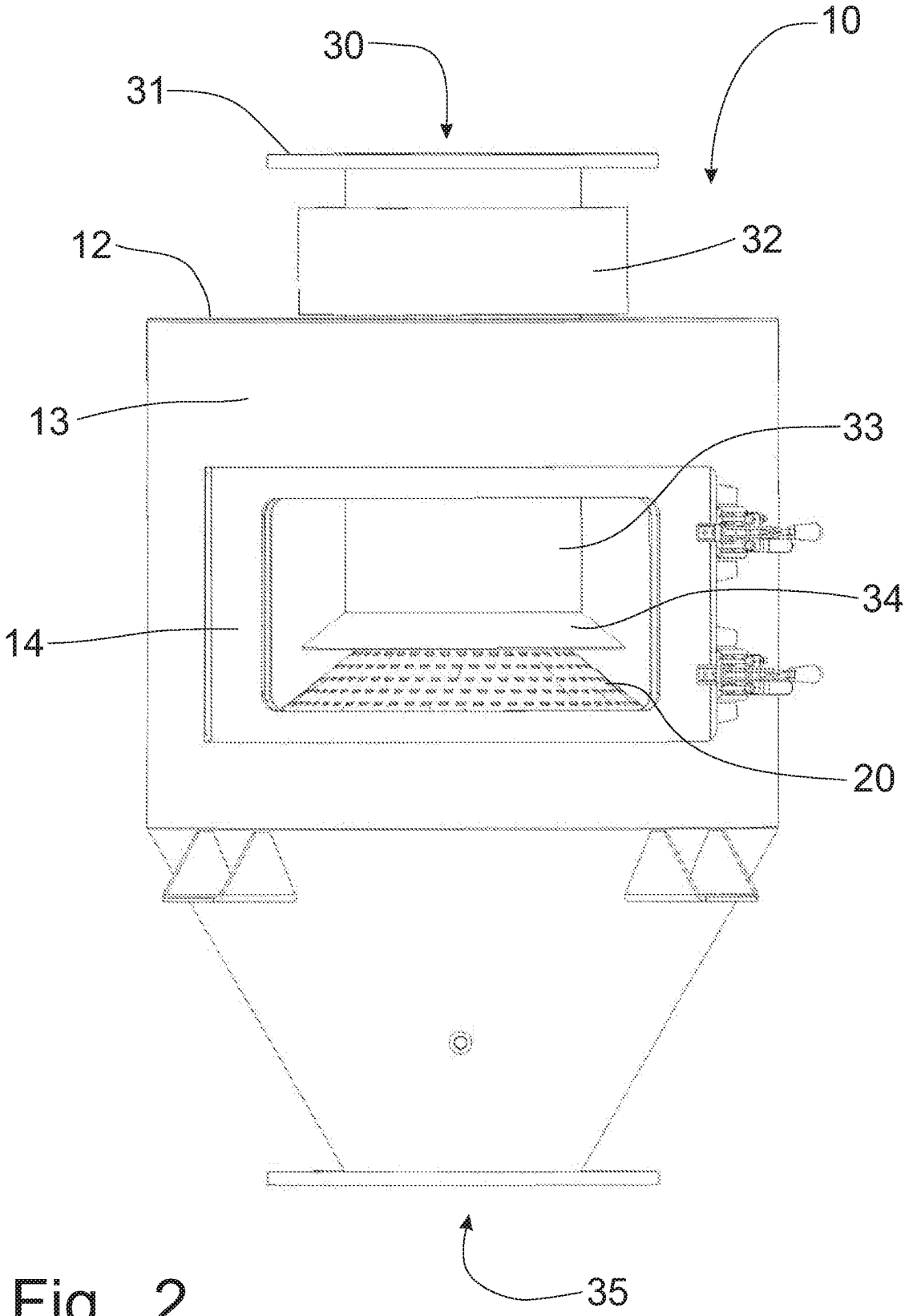
FIG. 2 is a front elevational view of the half round cylindrical dedusting apparatus shown in FIG. 1.
Figure 3:
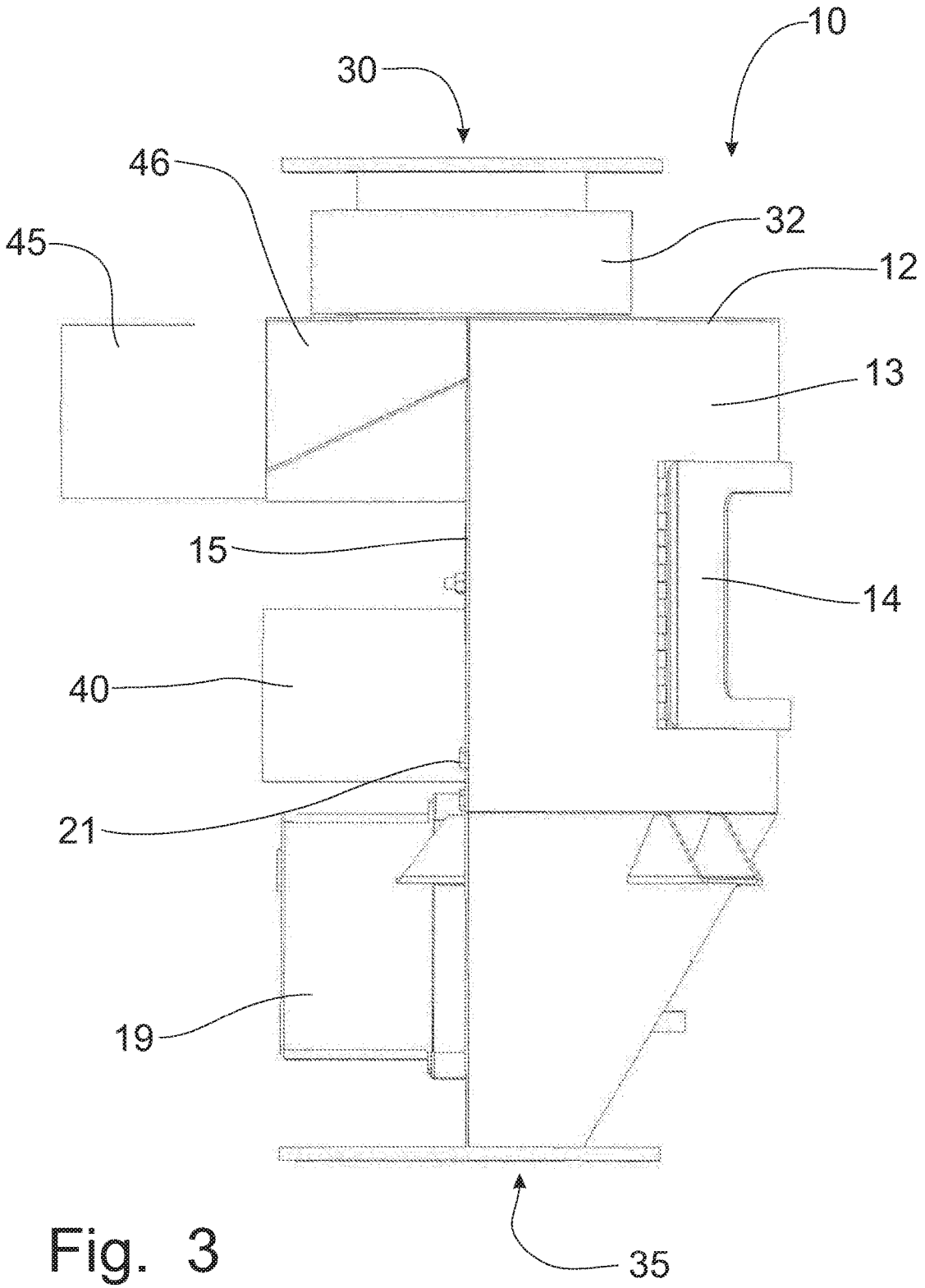
FIG. 3 is a right side elevational view of the half round cylindrical dedusting apparatus shown in FIGS. 1 and 2.
Figure 4:
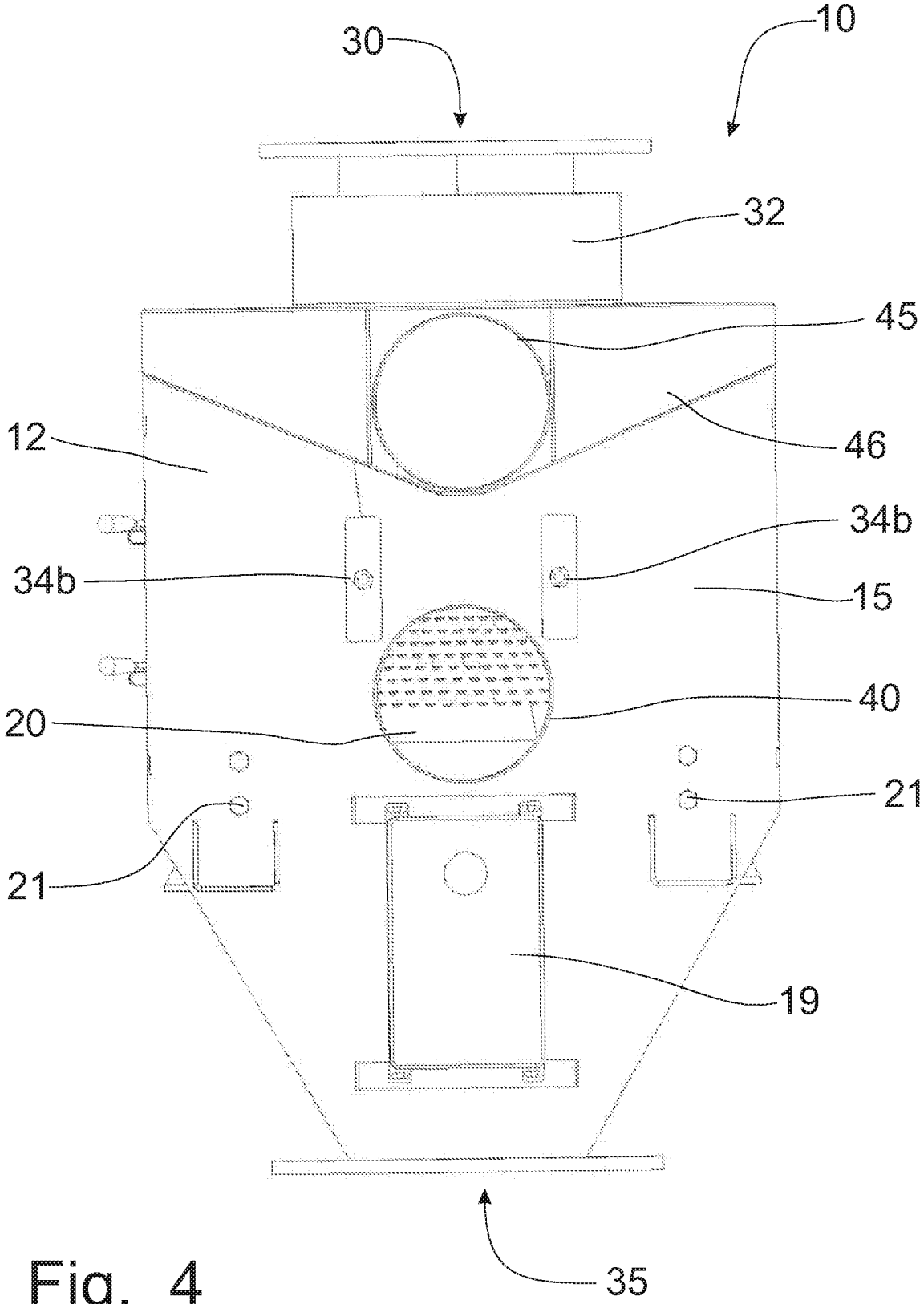
FIG. 4 is a rear elevational view of the half round dedusting apparatus.
Figure 5:
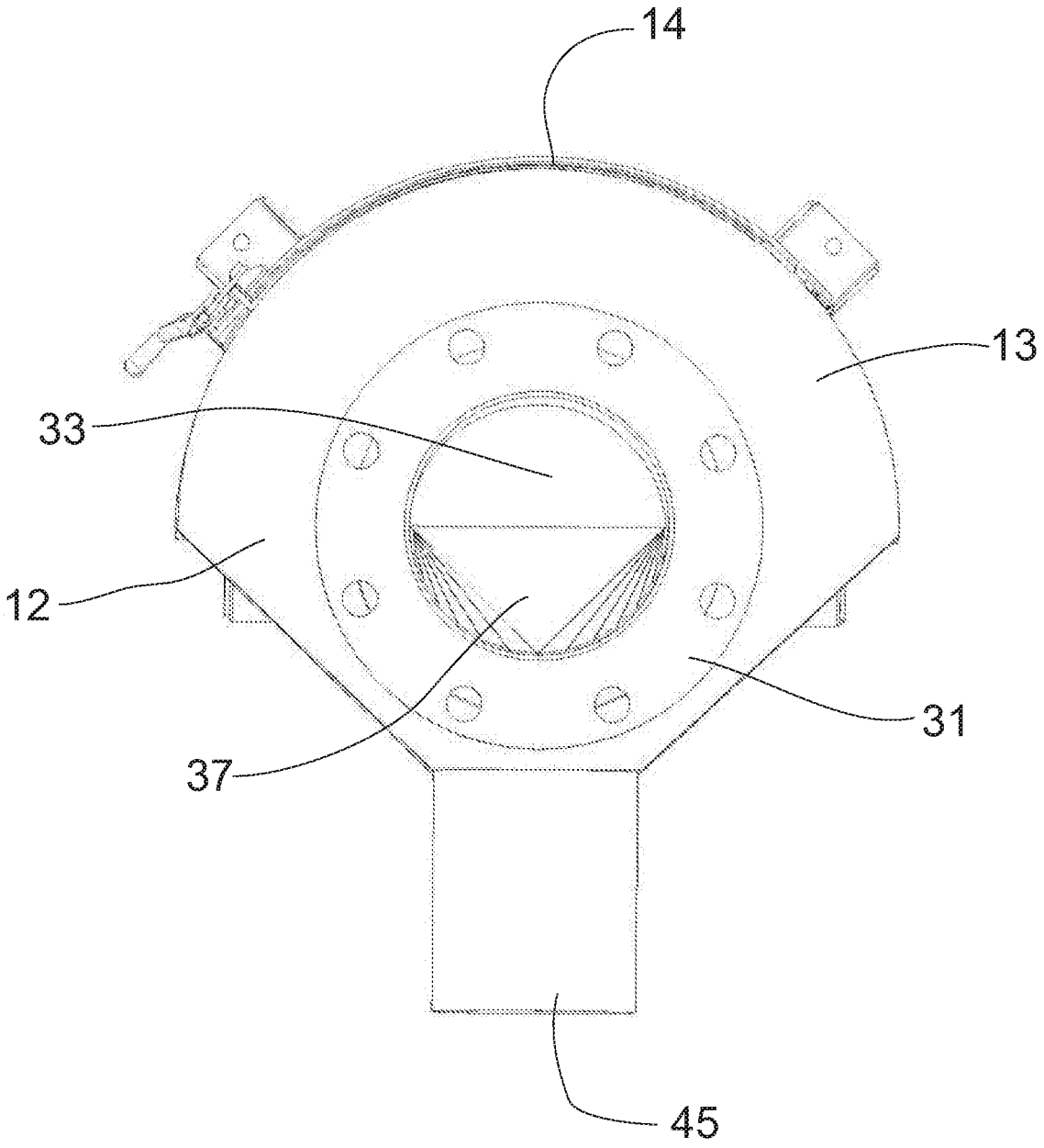
FIG. 5 is a top plan view of the half round cylindrical dedusting apparatus.

Referring to FIGS. 1-8, a half round cylindrical dedusting apparatus incorporating the principles of the instant invention can best be seen. The half round cylindrical dedusting apparatus utilizes the known dedusting techniques disclosed in U.S. Pat. No. 8,312,994, issued to Heinz Schneider and Paul Wagner on Nov. 20, 2012, which is the same general principle of the dedusting techniques disclosed in U.S. Pat. No. 5,035,331, issued to Jerome I. Paulson on Jun. 3, 1991, including the passage of pressurized air through a sloped, slotted wash deck, and the passage of air through a Venturi zone where particulate material passes. However, these known contaminant removing techniques are structured in a different configuration heretofore unknown in the art.

The dedusting apparatus 10 is generally semi-cylindrical in shape and configuration with a rounded front portion terminated by a back wall 15. The housing 12 includes a front housing 13 that is generally formed as a semi-circular shape, as viewed from above in FIG. 5 with a front access door 14 that is hinged to the front housing 13 and latched to be airtight against the front housing 13. The front access door 14 provides access to the wash deck 20 mounted on the back wall 15 internally of the front housing 13. The lower portion of the housing 12 slopes rearward from the front housing 13 to funnel cleaned particulate material to the discharge opening 35. The rear of the housing 12 is a back wall 15 that is substantially aligned with the center of the circular particulate material inlet port 30. A control box 19 for electrical power and other controls is supported on the rear of the back wall 15.

Figure 13:
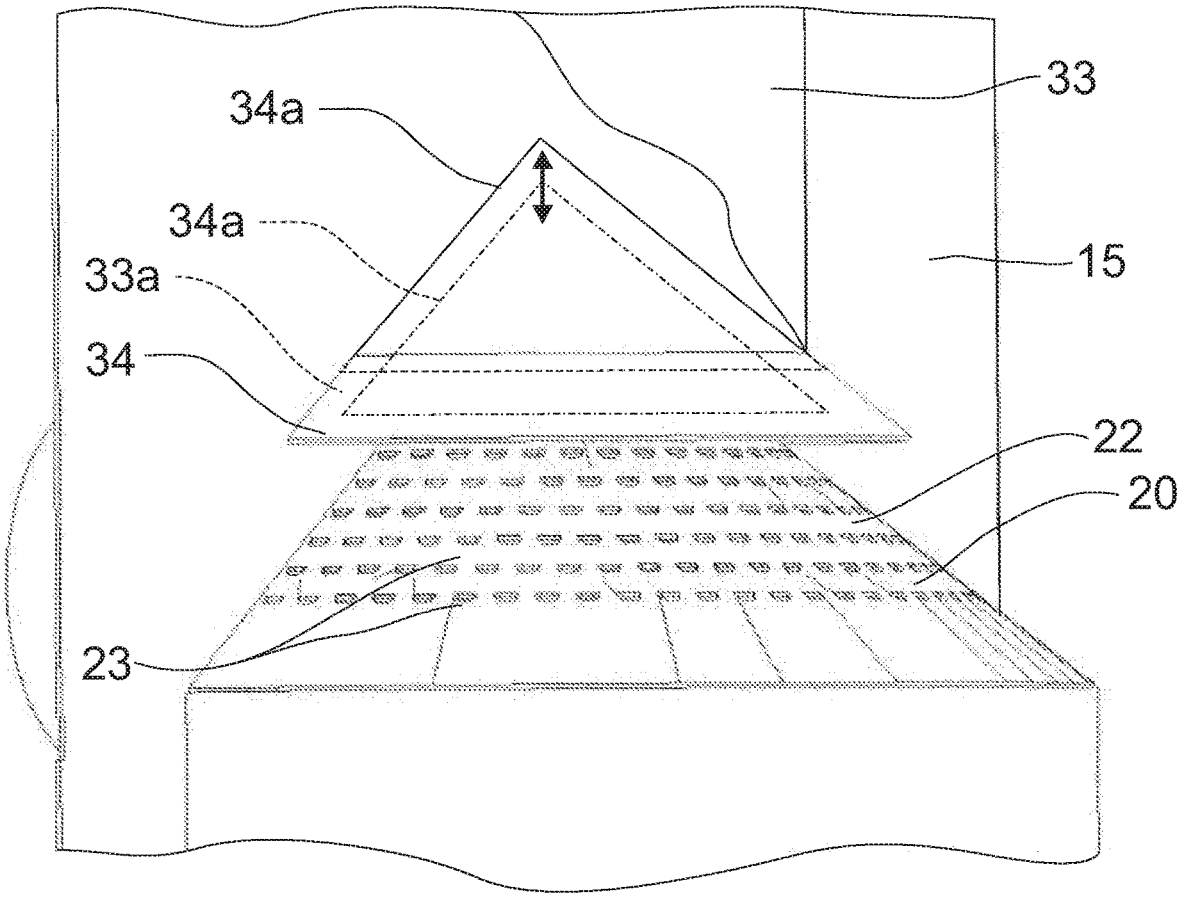
FIG. 13 is an elevational view of the wash deck.

The wash deck 20, which is also shown in FIG. 13, is formed as an inverted half cone with a plurality of apertures 23 extending around the entire peripheral surface of the wash deck 22 to direct air flow through the particulate material passing over the wash deck 20, as will be described in greater detail below. The wash deck 20 is detachable mounted to the back wall 15 through fasteners 21 extending through the back wall 15. The portion of the back wall 15 immediately rearwardly of the wash deck 20 is impervious so that the air flowing into the wash deck, as described below, will be properly directed to clean the particulate material passing over the outer peripheral surface 22 of the wash deck 20. The wash deck 20 is also formed with a bottom member 26 that is operable to create a flow of cleansing air into the Venturi zone 25.

The apertures 23 in the wash deck 20 are formed to direct air flow uniformly through the wash deck 20 to remove contaminant particles from the particulate material passing over the wash deck 20 from the particulate material inlet port 30. While the drawings reflect discrete lines of apertures 23 on the wash deck 20, one skilled in the art will recognize that other aperture distribution patterns may provide a different or even a more efficient distribution of air flow through the wash deck 20. Thus, the depiction of the apertures 23 on the wash deck 20 in the drawings is intended to be schematic and representative of an apertured wash deck 20, rather than representing a determinative pattern.

The tip 24 of the wash deck 20 is located adjacent the back wall 15 at the center point of the product inlet tube 33 delivering particulate material from the product inlet port 30. A partial-conical deflector member 34 is shaped to conform to the shape of the wash deck 20 and is mounted to the back wall 15 at the end of the product inlet tube 33 to permit vertical positioning thereof relative to both the wash deck 20 and the product inlet tube 33. The vertical movement of the deflector member 34 changes the dimension of the gap 33*a* between the deflector member 34 and the outer peripheral surface 22 of the wash deck 20, best seen in FIG. 13, from a zero spacing if lowered sufficiently to engage the surface 22 of the wash deck 20. The position of the deflector member 34 controls the flow rate of particulate material over the outer peripheral surface 22 of the wash deck 20.

A preferred embodiment of the deflector 34 is best seen in FIG. 13. The deflector flange 34*c* and the product inlet tube 33 are fixed relative to the back wall 15 and are not movable relative to one another. A partial-conical deflector 34*a* is secured to the back wall 15 by fasteners and plates 34*b* that are received within slots (not shown) formed in the back wall 15 to permit the vertical movement of the partial-conical deflector 34*a* relative to the back wall 15, and therefore, relative to the deflector flange 34 and the product inlet tube 33. By moving the partial-conical deflector 33*a* vertically, the opening or gap 33*a* between the partial-conical deflector 33*a* and the deflector flange 34 varies in dimension to allow a control of the flow rate of particulate material onto the peripheral surface 22 of the wash deck 20 from a zero flow, as shown in solid lines in FIG. 13, to a full flow, as is shown in phantom lines in FIG. 13. One skilled in the art will recognize that other configurations of the deflector member 34 and related components, 33, 34*a*, can provide the same advantages as the specific structure shown in FIG. 13.

Figure 9:
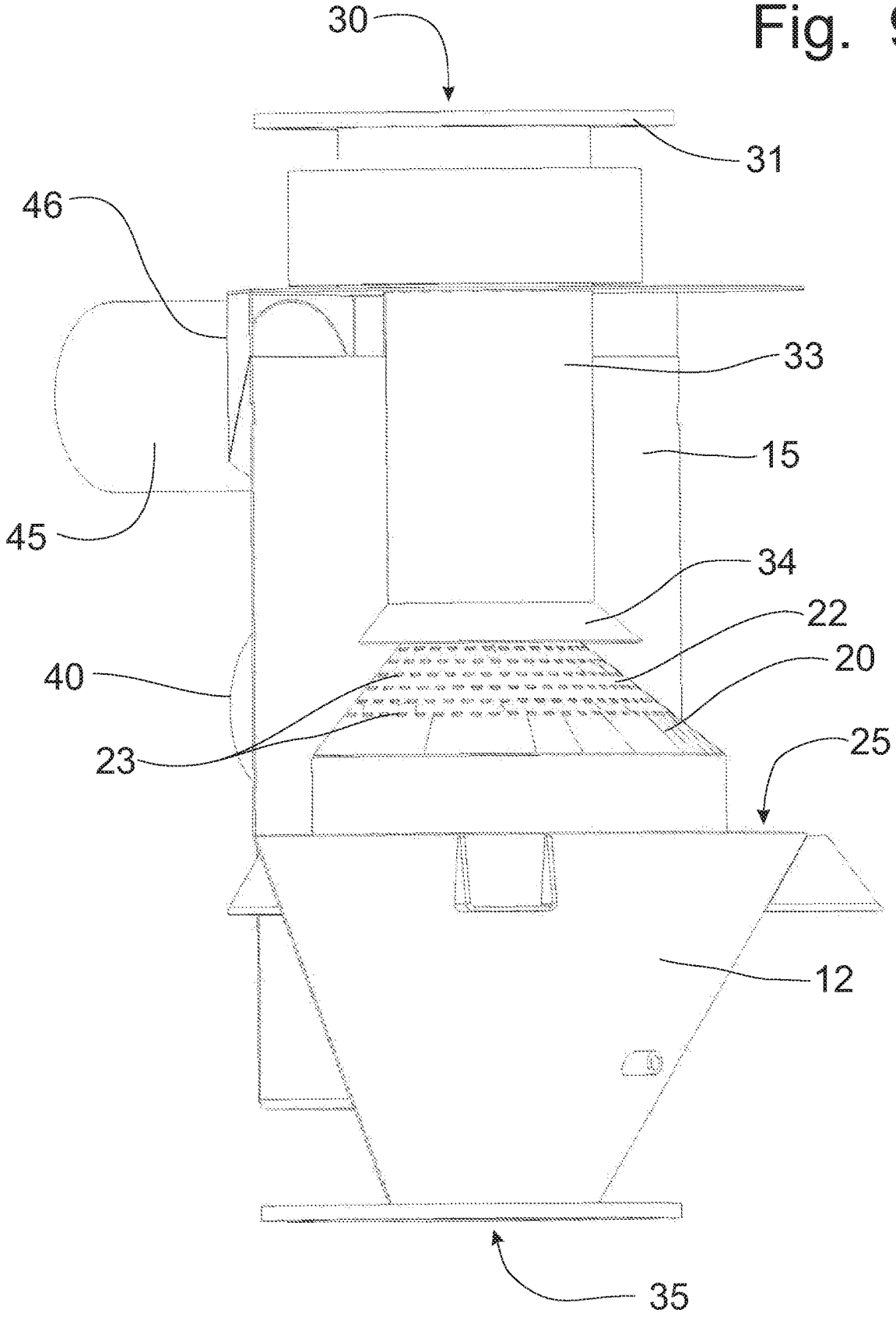
FIG. 9 is a front, right elevational view of the half round cylindrical dedusting apparatus with the semi-cylindrical front housing removed to provide an elevational view of the wash deck and the particulate material inflow.
Figure 10:
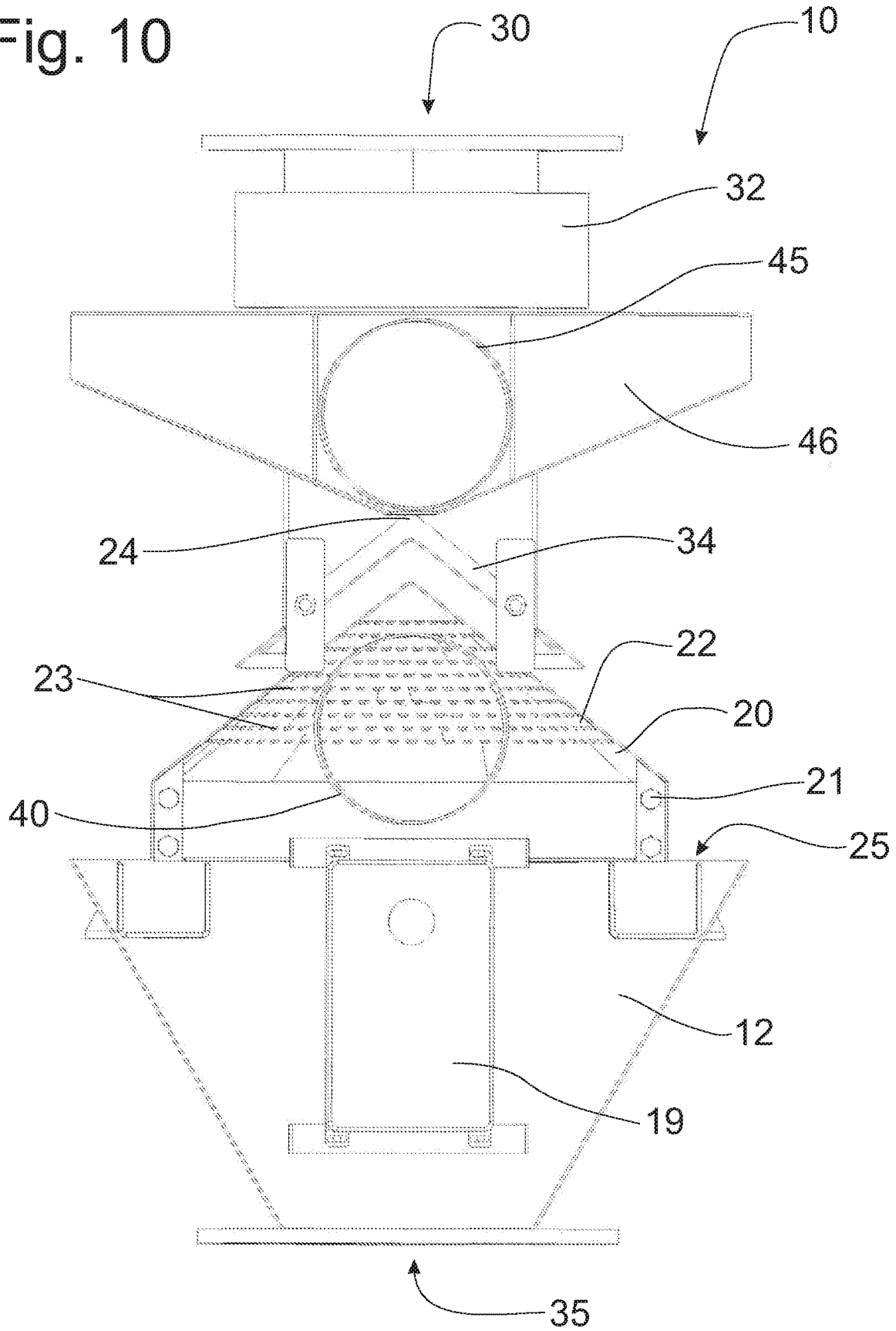
FIG. 10 is a rear elevational view of the half round cylindrical dedusting apparatus as depicted in FIG. 9 but also having the back wall removed to provide a clearer view of the rear of the wash deck apparatus, air inflow and outflow apparatus, and the particulate material infeed apparatus.

At the very top of the front housing 13, the back wall 15 is open on the side of the product inlet tube 33, as is best seen in FIG. 9, to allow the passage of air to exit the front housing 13 and be discharged from the dedusting apparatus 10, as will be described in greater detail below. A manifold 46 collects the discharged air and directs the flow of contaminant-laden air to the air discharge port 45 for further processing at a remote location. The air inlet port 40 is located below the air discharge port 45 and presents a flow of cleansing air into the wash deck 20 to provide a cleaning operation to be described in greater detail below.

The particulate material inlet port 30 is located at the top of the dedusting apparatus 10 and includes a circular mounting flange 31 for connecting to a supply hopper (not shown) in a conventional manner to provide a supply of particulate material into the dedusting apparatus 10. Preferably, the top mounting flange 31 is spaced above the housing 12 to provide a mounting location for an electromagnetic coil 32 for generating a magnetic flux field that is operable to neutralize static charges between the particulate material and the contaminant particles and enhance the cleaning operation of the wash deck 20, as is known in the art. The lower portion of the housing 12 terminates at the particulate material discharge port 35 that can incorporate a mounting flange 36 to attach devices for receiving the cleaned particulate material, such as a rotary valve (not shown).

Figure 11:
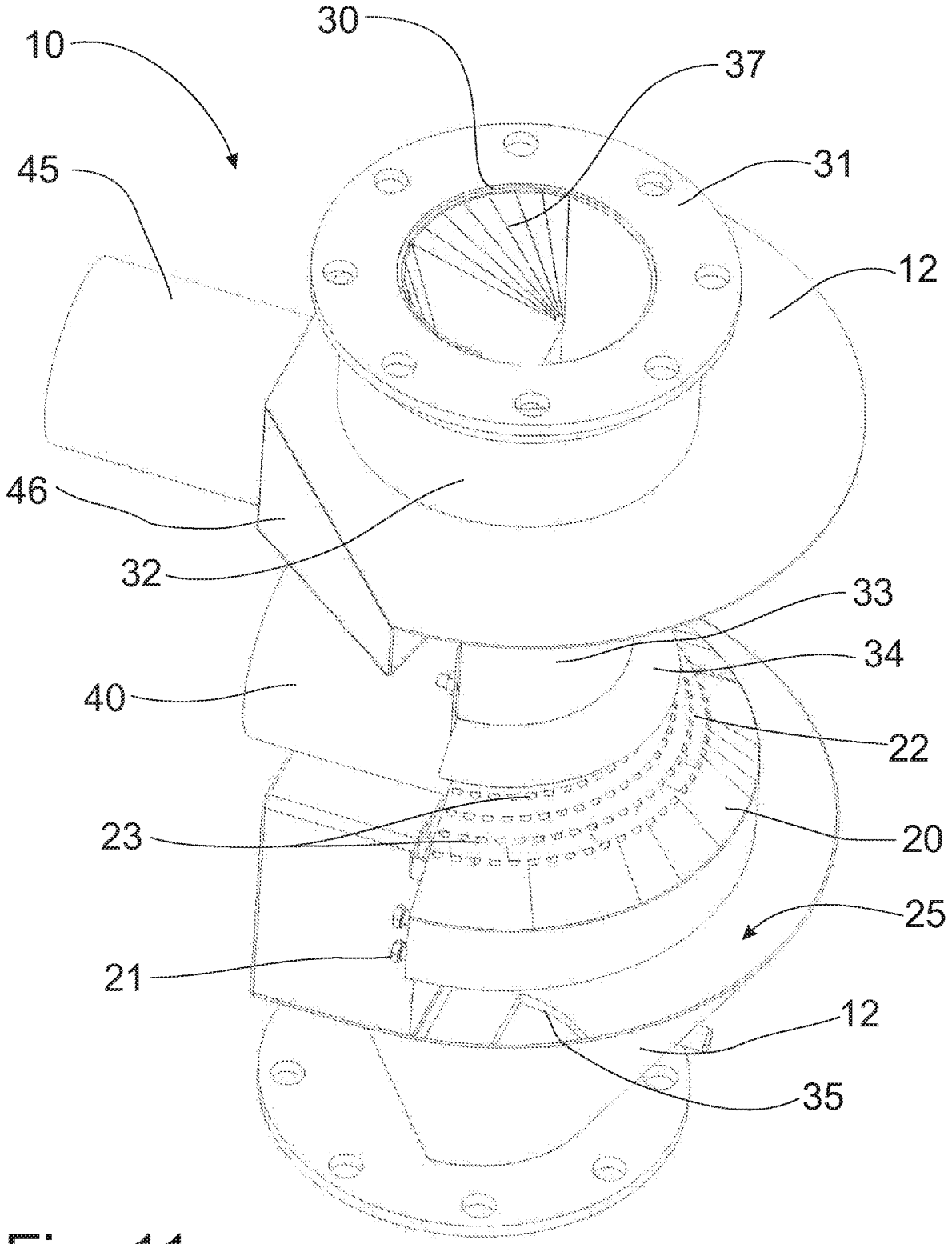
FIG. 11 is a right perspective view of the half round cylindrical dedusting apparatus as depicted in FIG. 10, with the front housing and back wall removed for purposes of clarity, to show the particulate material infeed port and the Venturi zone extending around the semi-circular circumference of the wash deck.
Figure 12:
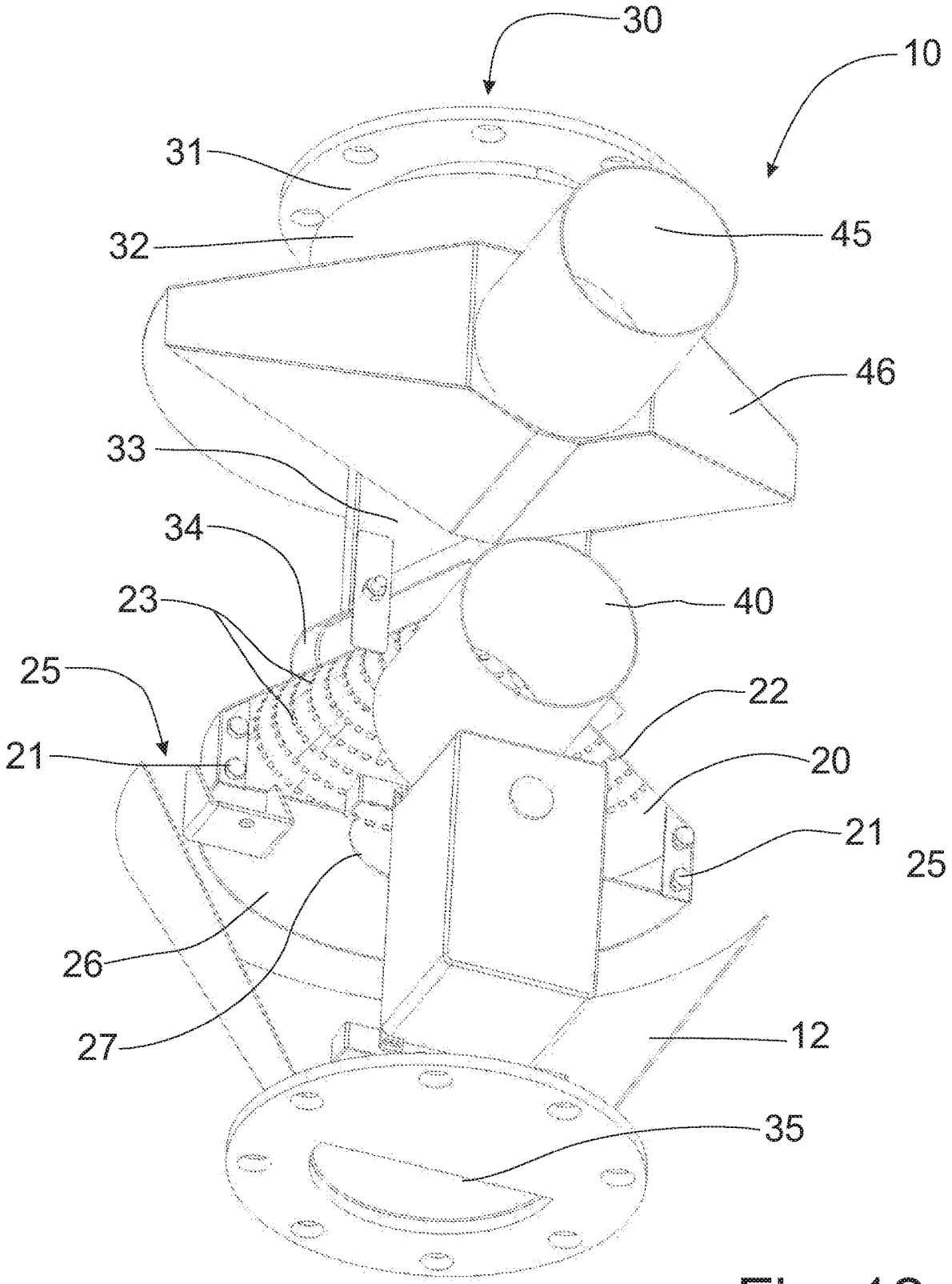
FIG. 12 is a lower rear perspective view of the half round cylindrical dedusting apparatus as shown in FIGS. 10 and 11 with the front housing and back wall removed for purposes of clarity to view the air inlet and the structure for creating the Venturi zone around the perimeter of the wash deck.

The air inlet port 40 delivers a supply of clean air under pressure through the back wall 15 and into the back side of the wash deck 20 to be passed through the apertures 23 in the wash deck 20 to remove contaminant particles from the particulate material passing over the wash deck 20. The air flow through the wash deck 20 moves upwardly with the contaminant particles entrained therein for removal from the dedusting apparatus 10 through the openings in the back wall 15 and outwardly through the air discharge port 45. Air also flows through the opening 27 in the bottom member 26 of the wash deck 20 to flow around the bottom member 26 and pass upwardly through the gap between the bottom periphery of the wash deck 20 and the front housing 13, as is best seen in FIGS. 11 and 12. The passage of clean air through this gap between the wash deck 20 and the front housing 13 creates a Venturi zone 25 that is effective to remove any remaining contaminant particles from the flow of particulate material falling off of the wash deck 20. The cleaned particulate material is then funneled down to the particulate material discharge port 35 for appropriate disposal.

Figure 6:
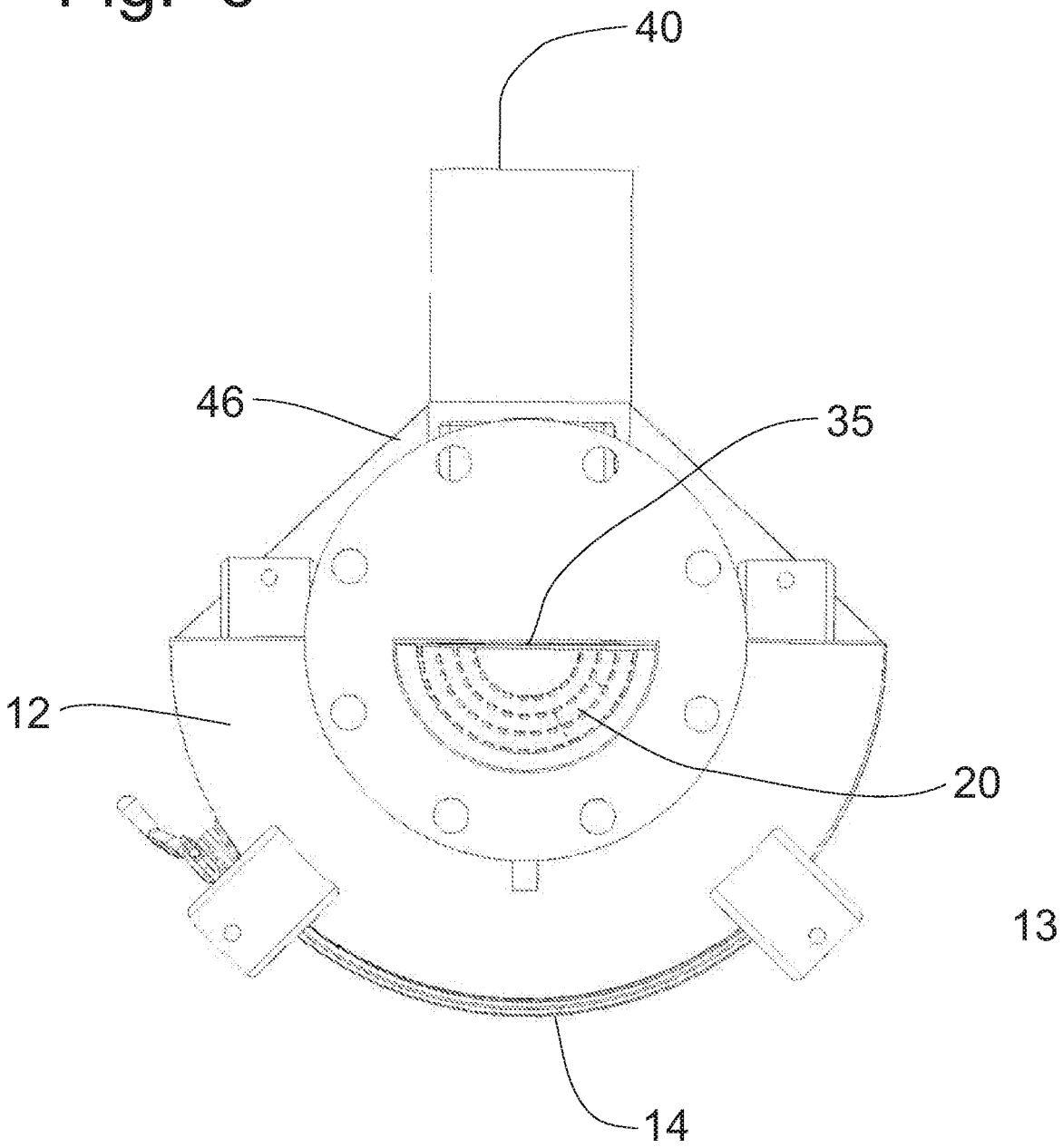
FIG. 6 is a bottom plan view of the half round cylindrical dedusting apparatus.
Figure 7:
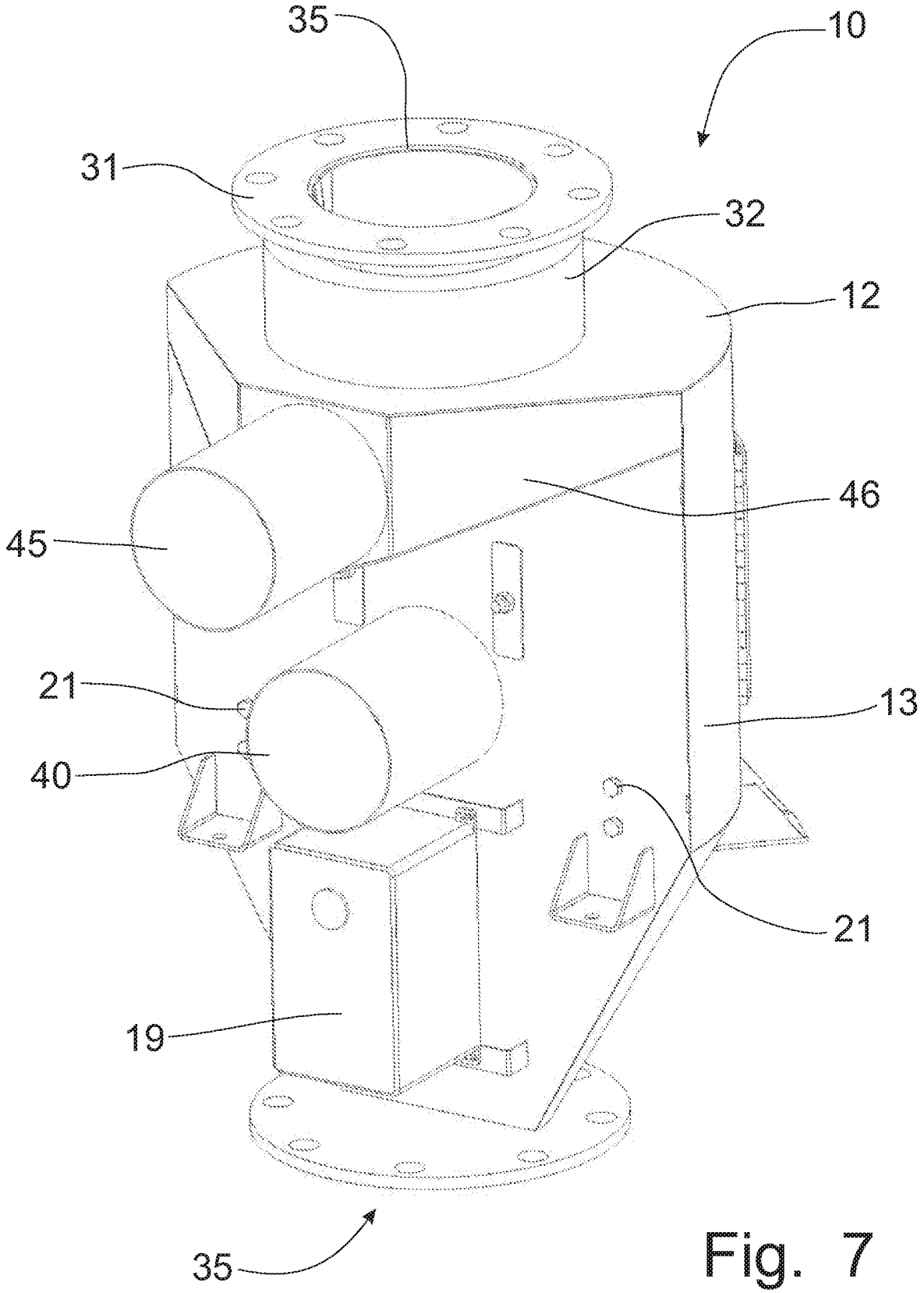
FIG. 7 is a right rear perspective view of the half round cylindrical dedusting apparatus.
Figure 8:
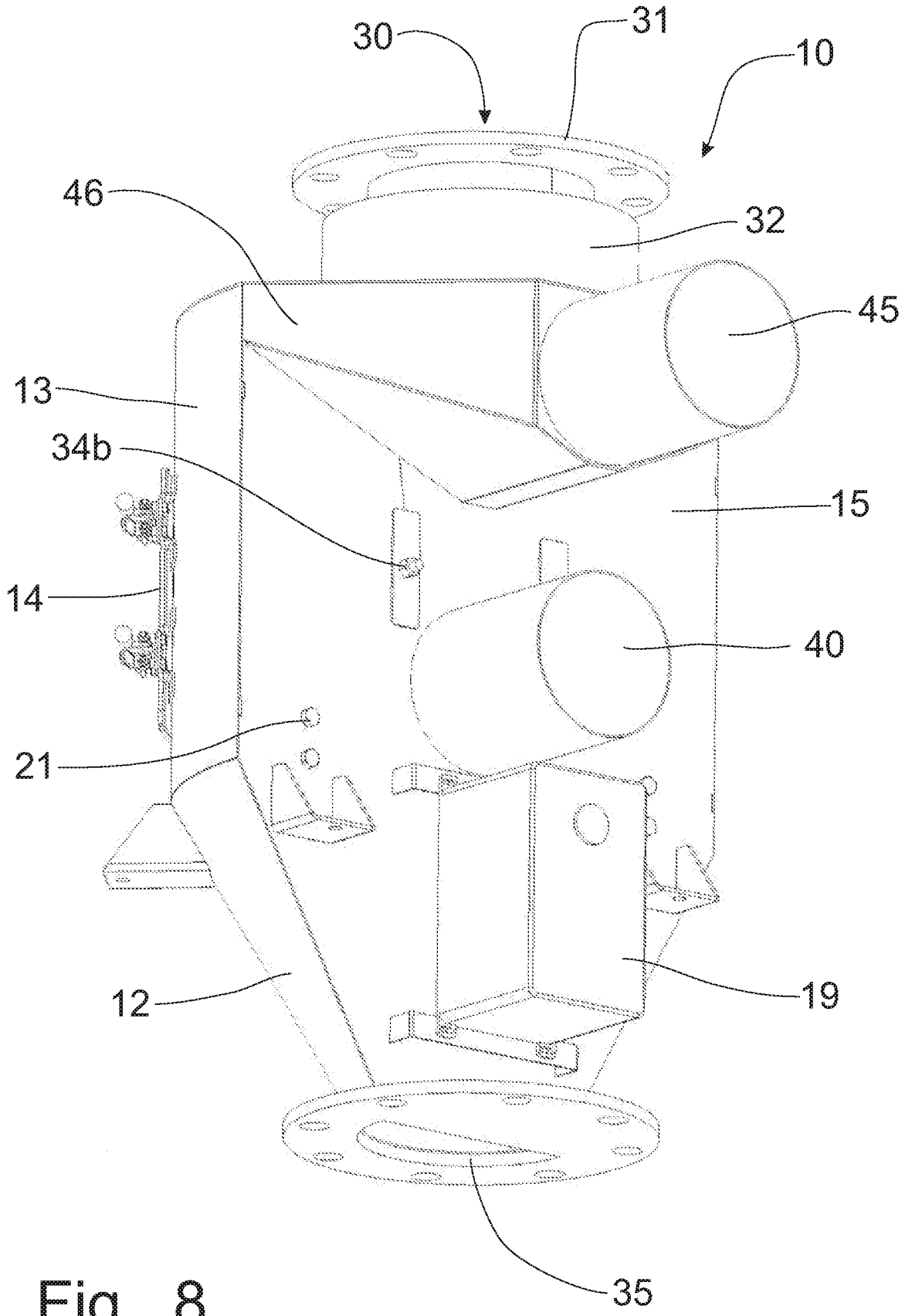
FIG. 8 is a left rear perspective view of the half round cylindrical dedusting apparatus.
Figure 16:
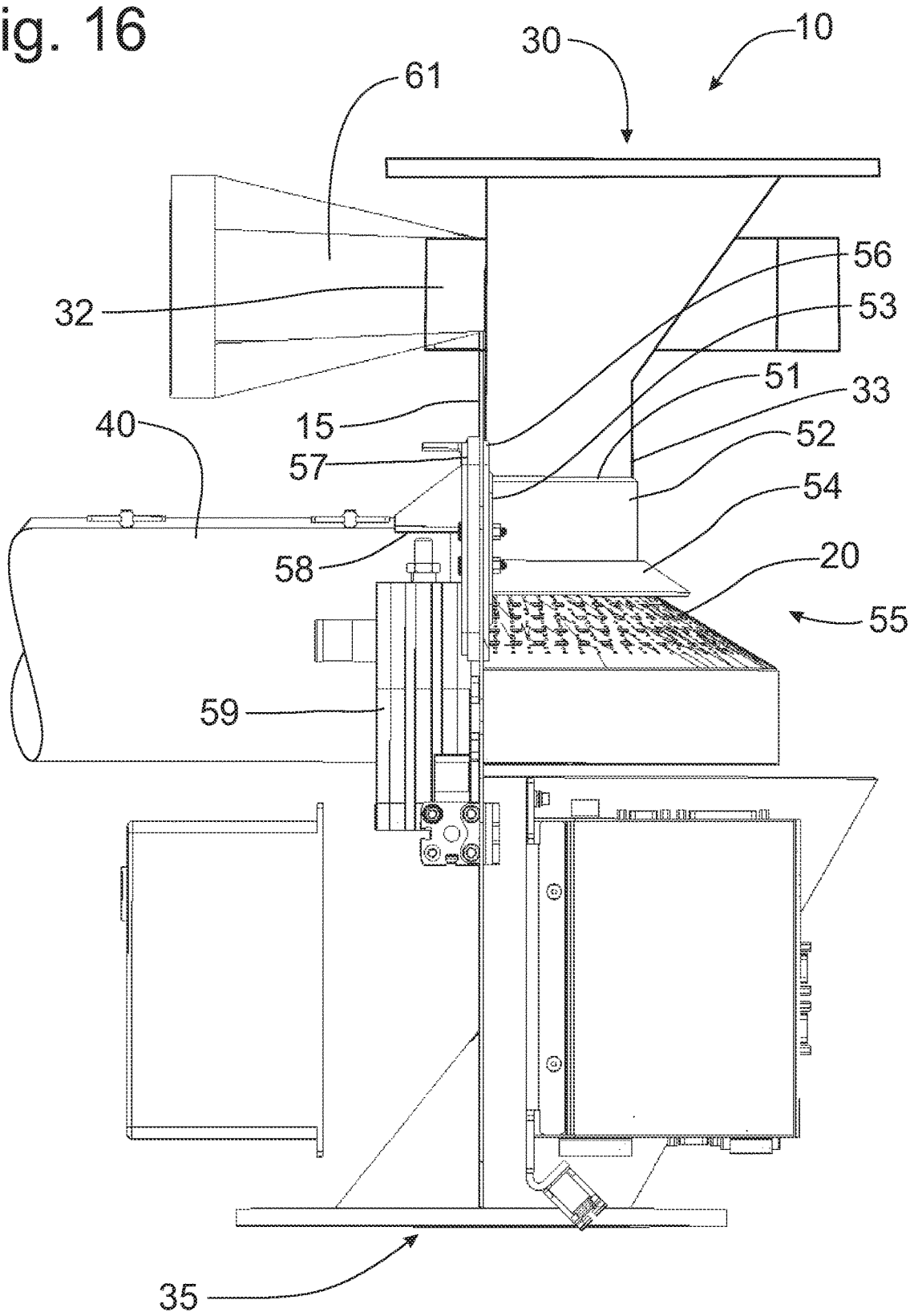
FIG. 16 is a side elevational view of the dedusting apparatus with portions of the housing removed as shown in FIG. 13 to depict an alternative enlarged product discharge port configuration.
Figure 17:
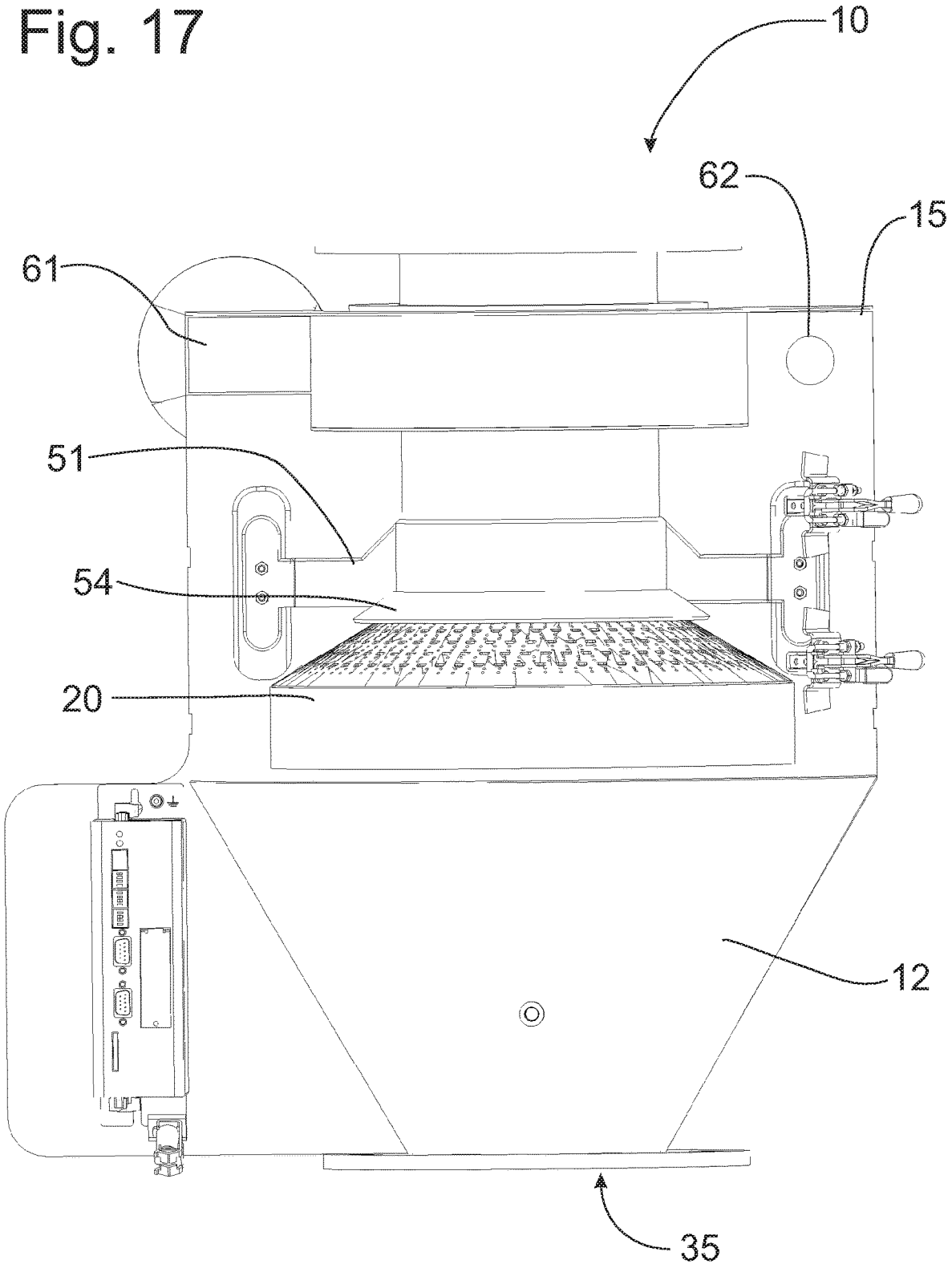
FIG. 17 is a front elevational view of the dedusting apparatus with portions of the housing removed to view an alternative orientation of the contaminant-laden air discharge ports at the height of the electromagnetic coil providing a magnetic flux applied to the particulate material passing through the product inlet port.

Because the wash deck 20 is shaped as a half cone and the particulate material is passing through a circular mounting flange 31 to be introduced into the dedusting apparatus 10 for cleaning, the inlet structure of the dedusting apparatus 10 can direct the flow of particulate material into a semi-circular opening that is the product inlet tube 33. While this semi-circular inlet opening is an acceptable configuration to match the partial conical configuration of the wash deck, a full circular inlet opening, as described in greater detail below, would be preferable. To accomplish that task, the inlet structure between the mounting flange 31 and the housing 12, corresponding to the positioning of the magnetic coil 32, is provided with a baffle 37 that directs the flow of particulate material to be cleaned into the product inlet tube 33 to be dispersed over the outer surface 22 of the wash deck 20. As can be seen in FIGS. 6, 8 and 12, the product discharge port 35 can also be a semi-circular opening for passage to the attached receiving device (not shown), but is preferably a full circular opening as is depicted in FIGS. 16-17.

For purposes of cleaning and maintenance of the dedusting apparatus 10, the wash deck 20 is removable from the back wall 15, as is the deflector member 34, and removable through the front access door 14 to permit cleaning separately from the housing 12. With the internal structure 20, 34 removed, the interior of the housing 12 from the product inlet tube 33 to the product discharge opening 35 can be cleaned easily.

In operation, the contaminant-laden particulate material is fed into the product inlet structure 30 through the mounting flange 31 and onto the baffle 37 where the particulate material is fed into the semi-cylindrical product inlet tube 33. With the tip 24 of the wash deck 20 positioned on the back wall 15 at the center of curvature of the product inlet tube 33, the particulate material is evenly spread across the entire outer peripheral surface 22 of the wash deck 20 beneath the deflector member 34. The positioning of the deflector member 34 relative to the wash deck 20 defines the flow rate of the particulate material over the wash deck 20, but also controls the movement of the particulates so that the flow of particulate material over the outer surface 22 of the wash deck 20 is laminar.

As the flow of particulate material passes over the wash deck 20, the flow of cleansing air passes through the apertures 23 and then through the flow of particulate material to remove dust, debris and other contaminants from the particulate material. Ultimately, the particulate material reaches the bottom of the wash deck 20 and falls off of the wash deck into the Venturi zone 25 where an additional flow of cleansing air passes through the falling particulate material to remove any remaining contaminant material. After passing through the Venturi zone 25, the cleaned particulate material is funneled into the product discharge port 35 for subsequent utilization. The contaminant laden air passing through the wash deck 20 and the Venturi zone 25 continues to the top of the housing 12 due to the pressure differential between the air inlet port 30 and the air discharge port 35 and carries the contaminants through the openings at the top of the back wall 15, into the manifold 46 and out through the air discharge port 35.

Figure 14:
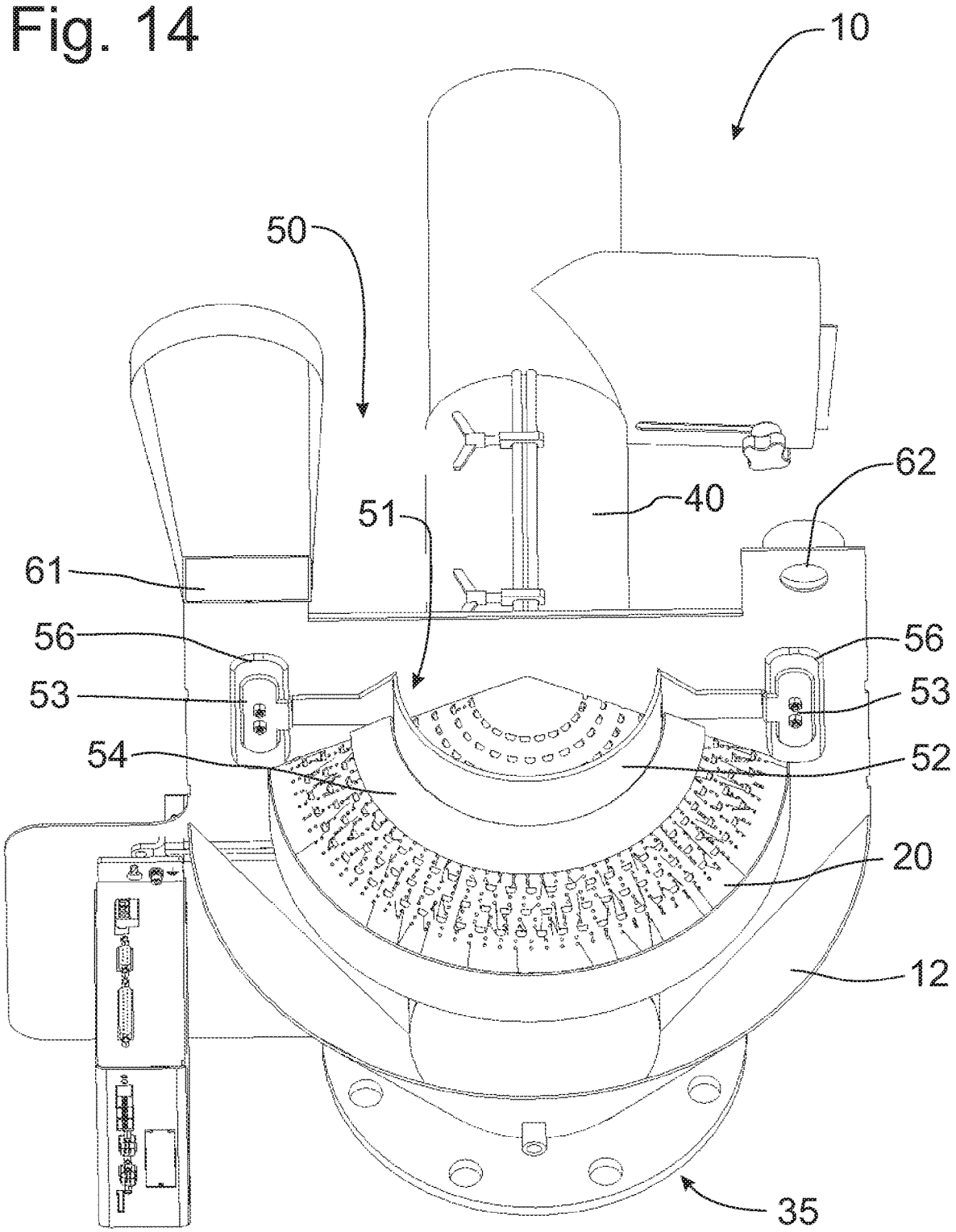
FIG. 14 is an enlarged perspective view of the dedusting apparatus with portions of the housing removed to view an alternative configuration for the flow control mechanism to control the rate of flow of particulate material over the wash deck and through the dedusting apparatus.
Figure 15:
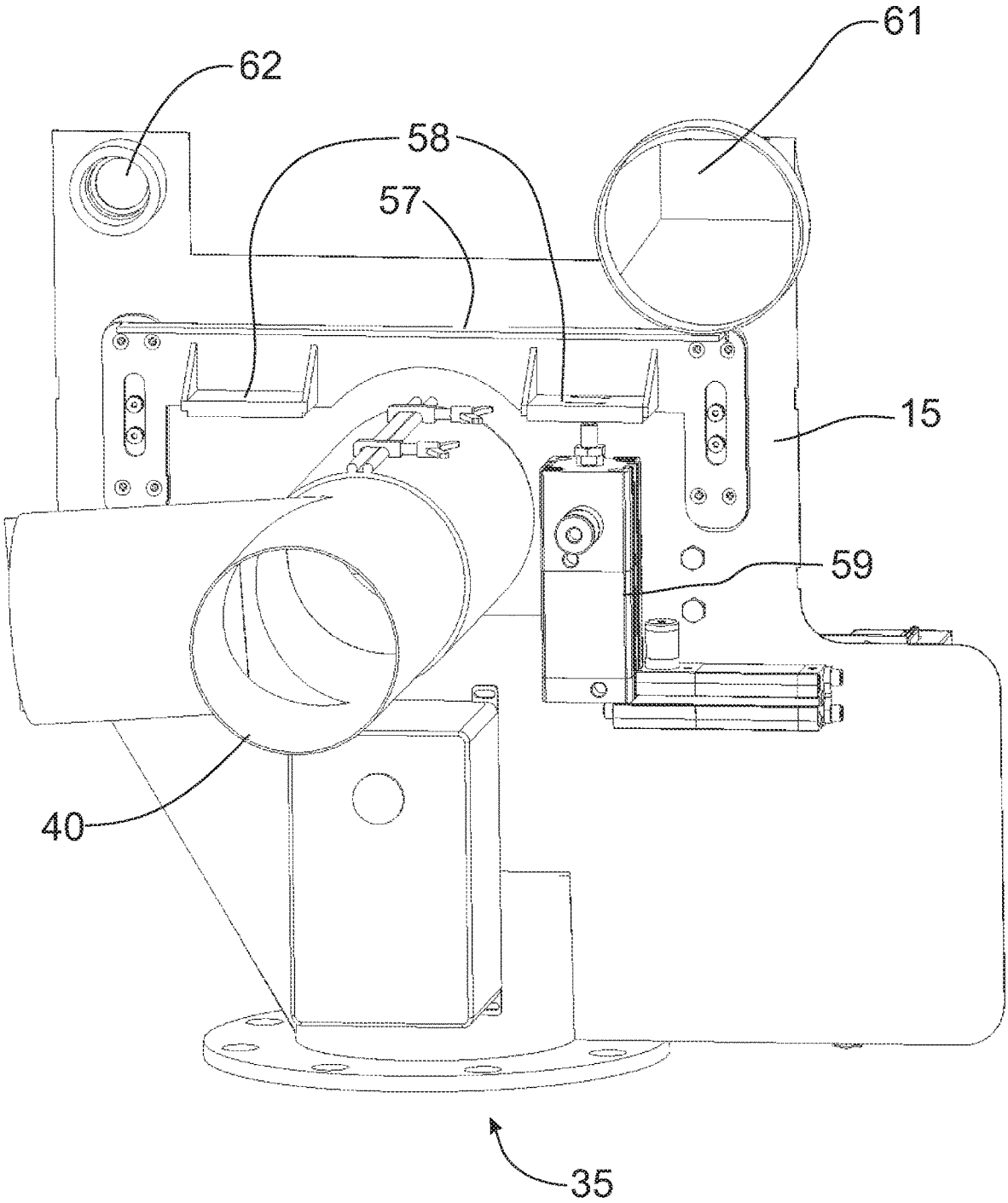
FIG. 15 is a rear elevational view of the dedusting apparatus shown in FIG. 13 to depict the actuator for the flow control mechanism.

An alternative configuration for the flow control mechanism 50 can best be seen in FIGS. 14 and 15. The deflector member 54 is shaped into a frusto-conical member having a smaller length than show in FIGS. 1-13. A knife member 51 is formed with a frusto-conical portion 52 that mates with and is attached to the deflector member 54, and with a pair of actuator wings 53 that extend laterally on opposing sides of the frusto-conical portion 52. The actuator wings 53 are connected to an actuator mechanism 55 mounted on the rear side of the back wall 15, as will be described in greater detail below. Each actuator wing 53 is supported on the interior side of the back wall 15 in engagement with anti-friction slides 56 to facilitate vertical movement of the knife member 51 through operation of the actuator 59 mounted on the rear side of the back wall 15.

The actuator mechanism 55 is best seen in FIG. 15 and includes a lift rack 57 extending between and connected to the actuator wings 53 through corresponding slots formed in the back wall 15. The linear actuator 59 is supported on the rear side of the back wall 15 and positioned to engage a lift handle 58 on the lift rack 57 to cause vertical movement thereof the lift rack 57. The linear actuator 59 can be powered hydraulic, electrically, or preferably pneumatically. The knife member 51 operates to move the deflector member 54 vertically relative to the surface of the wash deck 20 between a maximum raised position and a lowered position that places the deflector member 54 on top of the wash deck 20 to stop all flow of particulate material completely. The frusto-conical portion 52 rides on the outside surface of the product inlet tube 33 to keep the particulate material trapped within the product inlet tube 33 when the knife member is dropped to its lowered position.

As is seen in FIG. 16, the contaminant-laden air can be discharged through air discharge ports 61, 62 that are positioned at an extended portion of the housing 12 that surrounds the front side of the electromagnetic coil 32 and provides discharge openings that are at the same height above the product discharge port 35 through the back wall 15 on opposing sides of the magnetic coil 32. The contaminant-laden air discharge ports 61, 62 define an area of discharge that is smaller than the air inlet port 40 which results in an increased air velocity at the discharge ports 61, 62 and, therefore, creates a small vacuum to enhance the discharge of the dust and debris entrained within the flow of contaminant-laden air. Also noted in FIG. 16, is a configuration of the housing with a slanted lower rear wall that defines a full circular product discharge port 35 for enhanced discharge of particulate material from the housing 12, which corresponds to a fully circular product inlet opening 30 that delivers particulate material onto the partial conical wash deck 20.

Referring now to FIGS. 18-20, a second alternative particulate material flow control mechanism 70 can best be seen. In this configuration, the product inlet tube 33 terminates as a semi-circular knife edge 71 extending slightly below the intersection between the deflector member 54 and the product inlet tube 33. The knife edge 71 is formed as a semi-circular member to conform to the shape of the upper portion 72 of the wash deck 20 so as to engage the surface of the upper portion 72 uniformly around the wash deck 20. The wash deck 20 is separated into a movable upper portion 72 and a fixed lower portion 73, both of which are formed with slots, as noted above, for the passage of cleaning air to accommodate the movement of the particulate material over the wash deck 20. The upper portion 72 of the wash deck 20 is connected via a bracket 74 passing through the back wall 15 to a linear actuator 59, preferably a pneumatic cylinder. The manipulation of the extension of the pneumatic cylinder 59 thus controls the positioning of the upper portion 72 of the wash deck 20 relative to the lower portion 73.

As depicted in FIGS. 19 and 20, the upper portion 72 of the wash deck 20 can be lowered into engagement with the fixed lower portion 73 to open a gap between the semi-circular knife edge 71 and the surface of the upper portion 72 of the wash deck 20, thus allowing the flow of particulate material from the product inlet tube 33 and over the surface of the wash deck 20 for cleaning as described above. The positioning of the upper portion 72 of the wash deck 20 into a raised position places the upper portion 72 into engagement with the semi-circular knife edge 71. This engagement and the shape of the knife edge 71 terminate the movement of particulate material from the product inlet tube 33, as is represented in FIG. 20. One skilled in the art will recognize that the upper portion 72 of the wash deck 20 is positionable at intermediate positions between that depicted in FIGS. 19 and 20 to provide a control of the rate of flow of particulate material over the surface of the wash deck 20.

Preferably, the fixed lower portion 73 of the wash deck 20 is preferably closed at the upper boundary thereof so that particulate material cannot move in some manner around the upper portion 72 into the gap between the upper and lower portions 72, 73 and, thereby, bypass the cleaning thereof by passing over the outer surface of the wash deck 20. The lower peripheral edge of the upper portion 72 could be formed with a slight overlap with the lower portion 73 or with a slightly curled lip that moves particulate material away from the gap between the upper and lower portions 72, 73 to further assure that particulates will not enter the gap between the upper and lower portions 72, 73. This knife edge 71 could also be incorporated into the alternate flow control mechanism 50 that is shown and described in greater detail above to provide a positive engagement edge against the wash deck 20.

It will be understood that changes in the details, materials, steps and arrangements of parts, which have been described and illustrated to explain the nature of the invention will occur to and may be made by those skilled in the art upon a reading of this disclosure within the principles of the scope of the invention. The foregoing description illustrates the preferred embodiment of the invention; however, concepts, as based upon the description may be employed in other embodiments without departing from the scope of the invention. Accordingly, the following claims are intended to protect the invention broadly, as well as in the specific form shown.

Having thus described the invention, what is claimed is:

1. A dedusting apparatus for cleaning contaminants from contaminate-laden particulate material, comprising:

a housing including a semi-cylindrical front housing and a planar back wall, said back wall cooperating with said front housing to form a half-round cylinder configuration;

a product inlet port having a product inlet tube through which particulate material is introduced into said housing and a product discharge port through which particulate material is discharged from the housing;

a partial-conical wash deck terminating in a tip located in alignment with said product inlet tube to direct the flow of said contaminant-laden particulate material uniformly over the partial-conical wash deck, the wash deck having an outer peripheral bottom edge that is spaced internally from said front housing to define a Venturi zone for the passage of air between said wash deck and said front housing; and said wash deck being formed with a plurality of apertures for the passage of air through the wash deck to separate said contaminants from said contaminant-laden particulate material passing from said product inlet tube over said wash deck.

2. The dedusting apparatus of claim 1 further comprising:

an air inlet port passing through said back wall to deliver a supply of air into said wash deck; and an air discharge port to discharge contaminant laden air from said housing.

3. The dedusting apparatus of claim 1 wherein said product inlet port is circular and said product inlet tube is semi-cylindrical, said dedusting apparatus further comprising:

a baffle to direct the flow of said particulate material into said product inlet tube.

4. The dedusting apparatus of claim 1 wherein said wash deck is detachably mounted to said back wall.

5. The dedusting apparatus of claim 1 further comprising a deflector member that is vertically movable relative to said wash deck and said product inlet tube to define the flow rate of particulate material passing from said product inlet tube onto said wash deck, said deflector member being connected to an actuator-controlled knife member that affects vertical movement of said deflector member to vary the flow rate of particulate material passing over said wash deck.

6. The dedusting apparatus of claim 1 wherein wash deck is formed with a movable upper portion and a fixed lower portion, said product inlet tube including a partial conical deflector member projecting therefrom and corresponding to the shape of said wash deck with said deflector member being positioned above said wash deck to direct contaminant-laden particulate material over the surface of said wash deck, said product inlet tube further including a knife edge extending below an intersection between said deflector member and said product inlet tube, said upper portion of said wash deck being vertically movable into a raised position that engages said wash deck with said knife edge to stop said contaminant-laden particulate material from moving over said wash deck.

7. The dedusting apparatus of claim 6 wherein said upper portion is connected to a bracket extending through said back wall to be operably connected to a linear actuator for controlling the vertical movement of said upper portion of said wash deck, said upper portion being movable between said raised position and a lowered position where said upper portion of said wash deck is separated from said knife edge to allow the positioning of said upper portion to control the flow rate of contaminate-laden particulate material over said lower portion of said wash deck.

8. A dedusting apparatus for cleaning contaminants from contaminate-laden particulate material, comprising:

a housing including a semi-cylindrical front housing and a planar back wall;

a product inlet port having a product inlet tube through which said contaminate-laden particulate material is introduced into said housing and a product discharge port through which particulate material is discharged from the housing;

a partial-conical wash deck terminating in a tip located at a center of curvature of said product inlet tube against said back wall to direct the flow of said contaminant-laden particulate material uniformly over the partial-conical wash deck, the wash deck having an outer peripheral bottom edge that is spaced internally from said front housing to define a Venturi zone for the passage of air between said wash deck and said front housing;

said wash deck being formed with a plurality of apertures for the passage of air through the wash deck to clean contaminants from said contaminant-laden particulate material passing from said product inlet tube over said wash deck.

9. The dedusting apparatus of claim 8 wherein said wash deck further including a bottom member closing a bottom portion of said wash deck assembly except for an opening through which air can pass to move into said Venturi zone.

10. The dedusting apparatus of claim 8 further comprising:

an air inlet port passing through said back wall to deliver a supply of air into said wash deck; and an air discharge port to discharge contaminant laden air from said housing.

11. The dedusting apparatus of claim 10 wherein said air discharge port is provided in an elevated portion of said housing and located on opposing sides of an electromagnetic coil surround said product inlet port.

12. The dedusting apparatus of claim 8 wherein said wash deck is detachably mounted to said back wall.

13. The dedusting apparatus of claim 8 further comprising a deflector member connected to a knife member that is vertically movable relative to said wash deck and said product inlet tube to define the flow rate of particulate material passing from said product inlet tube onto said wash deck, said knife member being mounted on phenolic slides and connected to a linear actuator mounted on an opposing side of said back wall.

14. The dedusting apparatus of claim 8 wherein wash deck is formed with a movable upper portion and a fixed lower portion, said product inlet tube including a partial conical deflector member projecting therefrom and corresponding to the shape of said wash deck with said deflector member being positioned above said wash deck to direct contaminant-laden particulate material over the surface of said wash deck, said product inlet tube further including a knife edge extending below an intersection between said deflector member and said product inlet tube, said upper portion of said wash deck being vertically movable into a raised position that engages said wash deck with said knife edge to stop said contaminant-laden particulate material from moving over said wash deck, said upper portion being operable connected to a linear actuator to control the vertical movement of said upper portion relative to said knife edge.

15. A dedusting apparatus for cleaning contaminants from contaminate-laden particulate material, comprising:

a housing including a semi-cylindrical front housing and a planar back wall;

a cylindrical product inlet port having a semi-cylindrical product inlet tube through which particulate material is introduced into said housing and a product discharge port through which particulate material is discharged from the housing;

a baffle to direct the flow of said particulate material from said product inlet port into said product inlet tube;

a partial-conical wash deck detachably mounted to said back wall and terminating in a tip located at a center of curvature of said product inlet tube against said back wall to direct the flow of said contaminant-laden particulate material uniformly over the partial-conical wash deck, said wash deck being formed with a plurality of apertures for the passage of air through the wash deck to clean contaminants from said contaminant-laden particulate material passing from said product inlet tube over said wash deck; and a knife member coupled with a deflector member that is vertically movable relative to said wash deck and said product inlet tube to define the flow rate of particulate material passing from said product inlet tube onto said wash deck, said knife member including a knife edge extending below said deflector member and a pair of laterally extending actuator wings being operably connected to a linear actuator to affect vertical movement of said deflector member and said knife member.

16. The dedusting apparatus of claim 15 wherein said front housing includes a front access door for accessing said wash deck, said wash deck being removable from said housing through said front access door.

17. The dedusting apparatus of claim 15 wherein the wash deck has an outer peripheral bottom edge that is spaced internally from said front housing to define a Venturi zone for the passage of air between said wash deck and said front housing.

18. The dedusting apparatus of claim 15 wherein said wash deck further including a bottom member closing a bottom portion of said wash deck assembly except for an opening through which air can pass to move between a peripheral edge of said wash deck and said housing to form a Venturi zone through which particulate material must pass before reaching said product discharge port.

19. The dedusting apparatus of claim 15 wherein said linear actuator is operatively engaged with a lift rack that extends across a rear side of said back wall to engage both actuator wings of said knife member to affect simultaneous movement of said actuator wings.

* * * * *